US008231111B2

(12) United States Patent
Chang

(10) Patent No.: US 8,231,111 B2
(45) Date of Patent: Jul. 31, 2012

(54) FOAM GENERATING APPARATUS

(75) Inventor: Jen-Chih Chang, Wurih Township (TW)

(73) Assignee: Mei Thung Co., Ltd., Wuri Township (TW)

( * ) Notice: Subject to any disclaimer, the term of this patent is extended or adjusted under 35 U.S.C. 154(b) by 325 days.

(21) Appl. No.: 12/703,151

(22) Filed: Feb. 9, 2010

(65) Prior Publication Data

US 2011/0193245 A1 Aug. 11, 2011

(51) Int. Cl.
*B01F 3/04* (2006.01)

(52) U.S. Cl. ... 261/79.2; 261/96; 261/109; 261/DIG. 26

(58) Field of Classification Search ..... 261/35, 261/79.2, 96, 97, 98, 109, 111, DIG. 26
See application file for complete search history.

(56) References Cited

U.S. PATENT DOCUMENTS 2,090,727 A * 8/1937 Gosmann ..... 261/94
2,492,037 A * 12/1949 Freeman et al. ..... 261/116
2,597,913 A * 5/1952 Webster ..... 261/116
4,103,876 A * 8/1978 Hasselman et al. ..... 366/173.1
4,330,086 A * 5/1982 Nysted ..... 239/8
4,830,790 A * 5/1989 Stevenson ..... 261/18.1
4,925,109 A * 5/1990 Flanagan et al. ..... 239/429
5,382,389 A * 1/1995 Goodine et al. ..... 261/18.1
5,404,957 A * 4/1995 McCormack ..... 169/70
7,229,067 B2 * 6/2007 Dimarzo et al. ..... 261/79.2

* cited by examiner

*Primary Examiner* — Charles Bushey
(74) *Attorney, Agent, or Firm* — Wang Law Firm, Inc.; Li K. Wang

(57) ABSTRACT

A foam generating apparatus has a body with an inlet end at one end and an outlet end at the other end; a wind averaging piece contained in the body and adjacent to the inlet end, a buffer space being defined between the side of the wind averaging piece toward the inlet end and the inner edge of the inlet end, and the wind averaging piece being provided with a plurality of radially arranged through holes; and a porous body disposed in the body and abutting against the side of the wind averaging piece toward the outlet end, and a foam collecting chamber being defined between the porous body and the inner edge of the outlet end.

6 Claims, 5 Drawing Sheets

FOAM GENERATING APPARATUS

FIELD OF THE INVENTION

The present invention relates to a cleaning apparatus, and more particularly to a foam generating apparatus capable of significantly increasing the foam generation capacity.

BACKGROUND OF THE INVENTION

A conventional high pressure spray-cleaning gun is as illustrated in FIG. 6, in which a cleaning solution receiver 92 is connected to the lower portion of a T junction 91, one end of the T junction 91 is connected to a nozzle 93, and the other end of the T junction 91 is connected to a handle 94. Compressed gas is controlled by the handle 94 and inputted through the T junction 91 to produce a Venturi tube effect, so that the cleaning solution in the cleaning solution receiver 92 can be pumped out and mixed by the nozzle 93 to form foam, which is then sprayed out.

However, a piece of foam 95 is mounted within the conventional nozzle 93, such that when the cleaning solution passes through the foam 95, it can be split or cleaved and then converted into foam. Nonetheless, according to the nozzle 93 of such structural design, when the cleaning solution enters the nozzle 93, it will directly enter the foam 95. Due to the influence of the specific gravity of the cleaning solution and the variation in the gas pressure, the cleaning solution entering the foam 95 cannot be effectively mixed, so that the amount of foam generated is clearly insufficient and thus the cleaning effect is significantly reduced. Furthermore, the nozzle opening 96 of the conventional nozzle structure 93 is a straight through hole, so the foam jetted therefrom is in a long column shape . When the surface area of an article to be cleaned is larger, it takes longer spraying time to complete a spraying operation for an entire large area. Therefore, it is more time-consuming and inconvenient.

SUMMARY OF THE INVENTION

A first object of the present invention is to provide a foam generating apparatus which has the effect of significantly increasing the foam generation capacity by means of a vortex flow effect.

A second object of the present invention is to provide a foam generating apparatus which has the effect of enabling more uniform and finer foam by means of a vortex flow effect.

A third object of the present invention is to provide a foam generating apparatus which has the effect of significantly shortening the working time spent by the user to spray the foam.

In order to achieve the foregoing objects, the present invention provides a foam generating apparatus, comprising:

- a body having a containing space inside and having an inlet end formed at one end and an outlet end formed at the other end;
- a wind averaging piece contained in the containing space of the body and adjacent to the inlet end, a buffer space being defined between the side of the wind averaging piece toward the inlet end of the body and the inner edge of the inlet end, and the wind averaging piece being provided with a plurality of through holes; and
- a porous body disposed in the containing space of the body and abutting against the side of the wind averaging piece toward the outlet end of the body, and a foam collecting chamber being defined between the porous body and the inner edge of the outlet end of the body.

The wind averaging piece is cone shaped with the apex of the cone toward the inlet end and the through holes are radially arranged and inclinedly arranged circumferentially along the wind averaging piece.

Furthermore, a diffusing piece is provided in the foam collecting chamber of the body, and the diffusing piece has one side abutting against the porous body and is provided with a plurality of through holes that are radially arranged and inclinedly arranged circumferentially along the diffusing piece.

Moreover, the body is formed with a conical surface gradually converging toward the outlet end at its end edge, and the outlet end is formed with a divergent surface gradually diverging outwardly at its end edge.

DETAILED DESCRIPTION OF THE PREFERRED EMBODIMENTS

Figure 1:
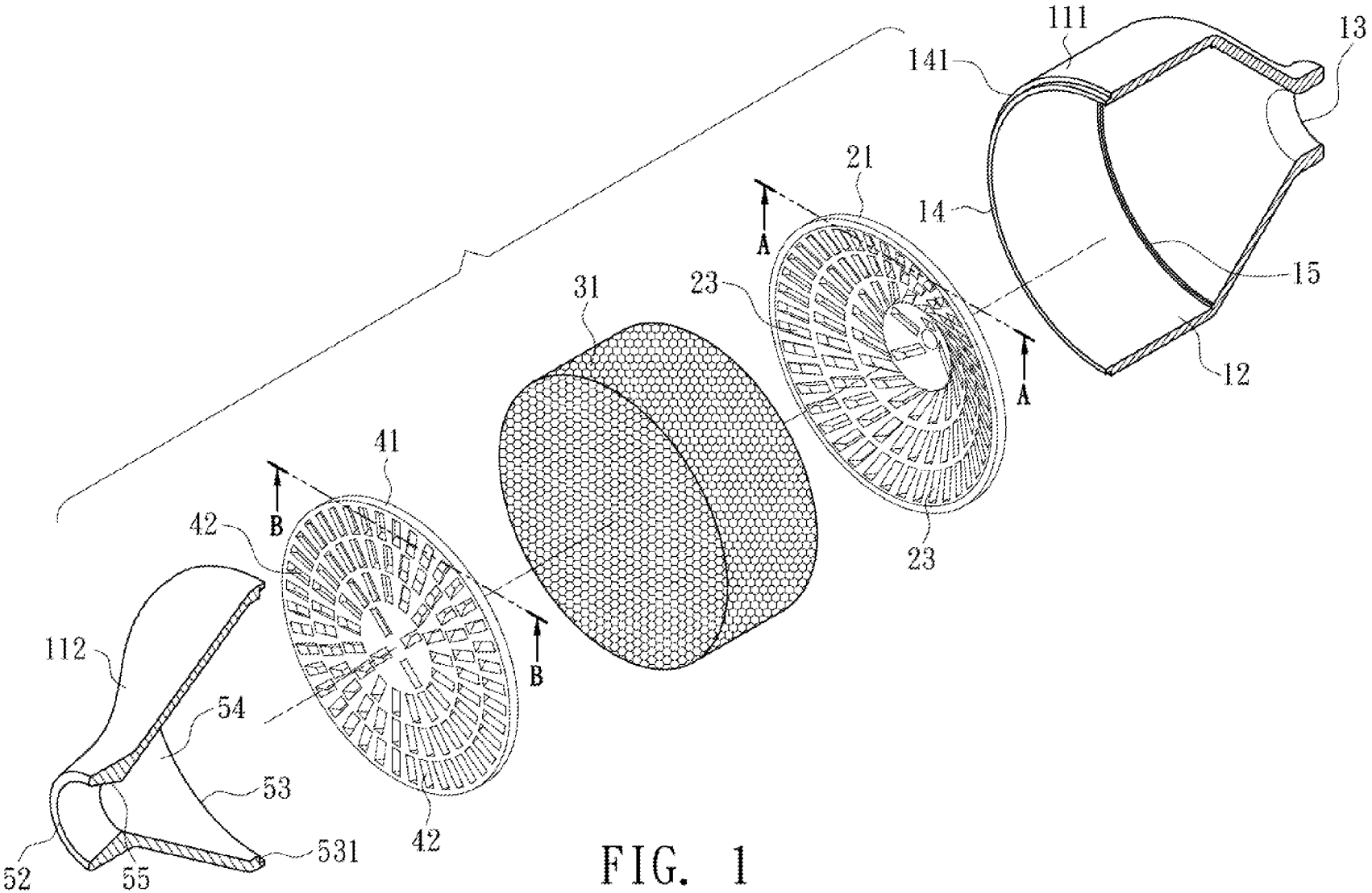
FIG. 1 is a three-dimensional exploded view of the present invention.
Figure 2:
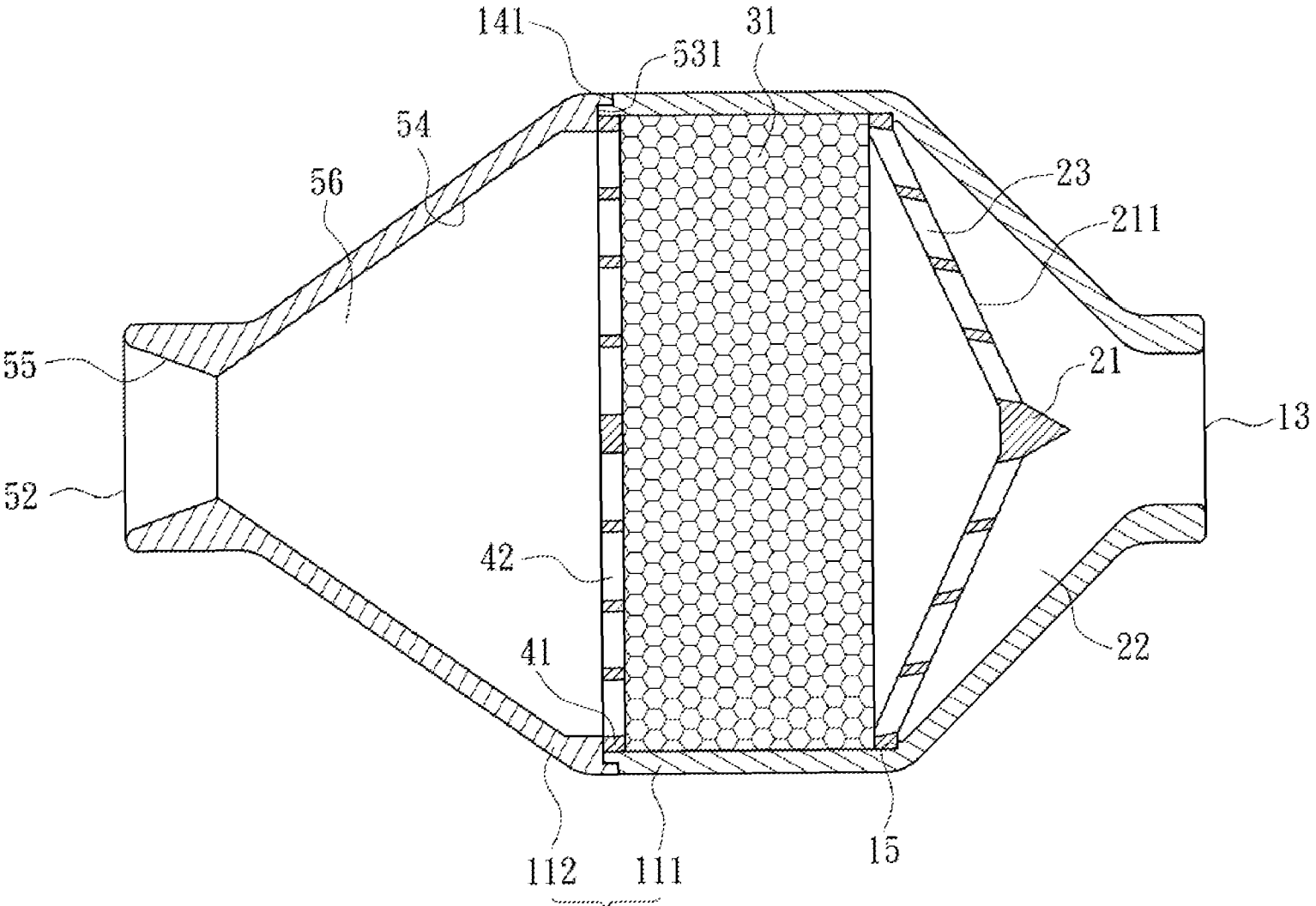
FIG. 2 is a schematic view showing a structure of the present invention after assembled.

First, referring to FIGS. 1 and 2, there is provided a foam generating apparatus, which is mainly sequentially comprised of a body 11, a wind averaging piece 21, a porous body 31, and a diffusing piece 41.

The body 11 is comprised of a back cover 111 and a front cover 112, which is a shell structure having a containing space 12 inside. The back cover 111 is formed with a convergent inlet end 13 at its one end and an opening end 14 at its other end. The inlet end 13 and the opening end 14 communicate with the containing space 12. The opening end 14 is formed with a stair-like engaging portion 141 at its end edge, and an abutting portion 15 is further formed at an appropriate position on the inner edge of the back cover 111.

Figure 3:
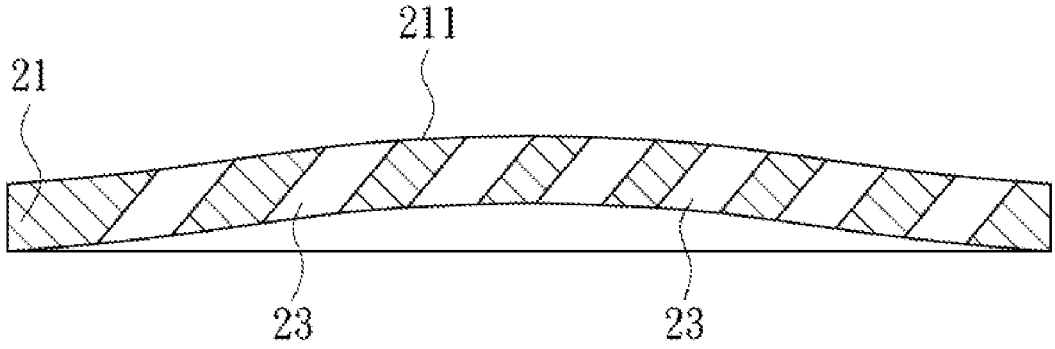
FIG. 3 is a cross-sectional view in the A-A direction of FIG. 1.

The wind averaging piece 21 is contained in the containing space 12 of the body 11 and adjacent to the inlet end 13. The end edge on the side of the wind averaging piece 21 toward the inlet end 13 abuts against the abutting portion 15 on the inner edge of the body 11. The wind averaging piece 21 is cone shaped with the apex of the cone 211 toward the inlet end 13. A buffer space 22 is defined between the side of the wind averaging piece 21 toward the inlet end 13 and the inner edge of the inlet end 13, and the wind averaging piece 21 is provided with a plurality of through holes 23 that are radially arranged and inclinedly arranged circumferentially along the wind averaging piece 21, as shown in FIG. 3.

The porous body 31 may be comprised of foam or other porous materials. The porous body 31 is contained in the containing space 12 of the body 11 and adjacent to the opening end 14, and the porous body abuts against the end edge on the other side of the wind averaging piece 21 at its one side.

Figure 4:
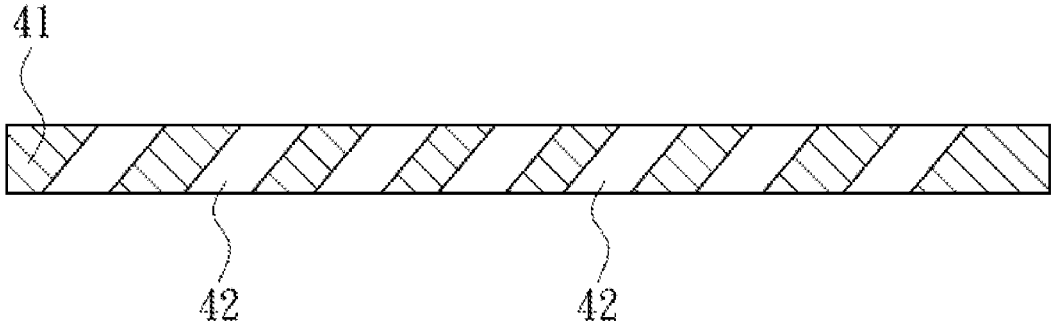
FIG. 4 is a cross-sectional view in the B-B direction of FIG. 1.

The diffusing piece 41 is formed in a flat sheet shape. The diffusing piece 41 is contained in the containing space 12 of the body 11 and adjacent to the opening end 14, and the diffusing piece 41 abuts against the other side of the porous body 31 at its one side. The diffusing piece 41 is also provided with a plurality of through holes 42 that are radially arranged and inclinedly arranged circumferentially along the diffusing piece 41, as shown in FIG. 4.

The front cover 112 has an outlet end 52 and a connecting end 53. The connecting end 53 of the front cover 112 is formed with an assembling portion 531 corresponding to the engaging portion 141 at the opening end 14 of the back cover 111. The front cover 112 has the assembling portion 531 of the connecting end 53 correspondingly engaged with the engaging portion 141 of the back cover 111, and the end edge of the assembling portion 531 of the front cover 112 can just abut against the other side of the diffusing piece 41 such that the diffusing piece 41, the porous body 31 and the wind averaging piece 21 can be pressed and firmly disposed in the containing space 12 of the back cover 111. The front cover 112 is formed with a conical surface 54 gradually converging toward the outlet end 52 on its inner edge, and the outlet end 52 is formed with a divergent surface 55 gradually diverging outwardly on its inner edge. A foam collecting chamber 56 is formed between the inner edge of the outlet end 52 of the front cover 112 and the diffusing piece 41.

Figure 5:
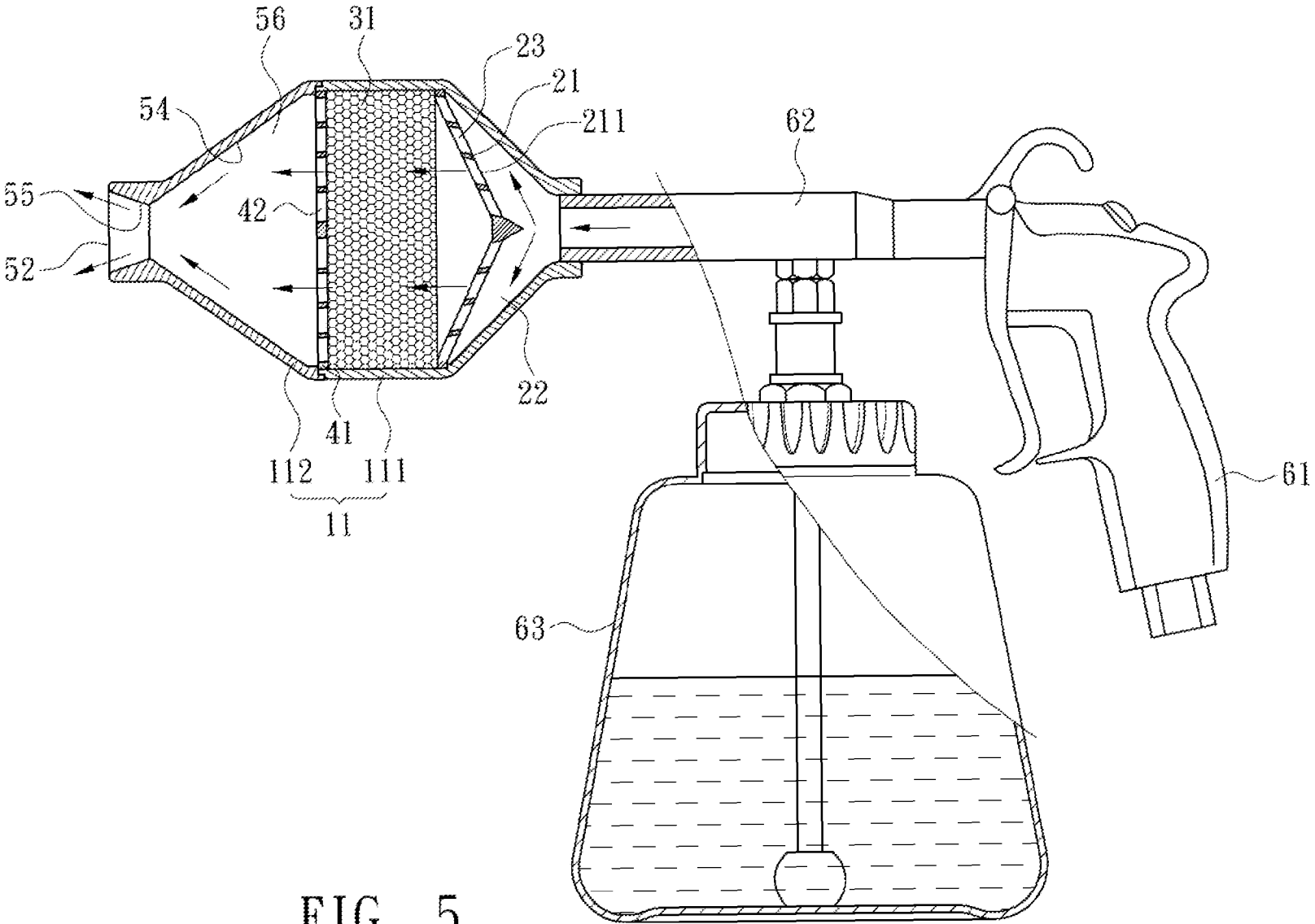
FIG. 5 is a schematic view showing a usage state of the present invention.
Figure 6:
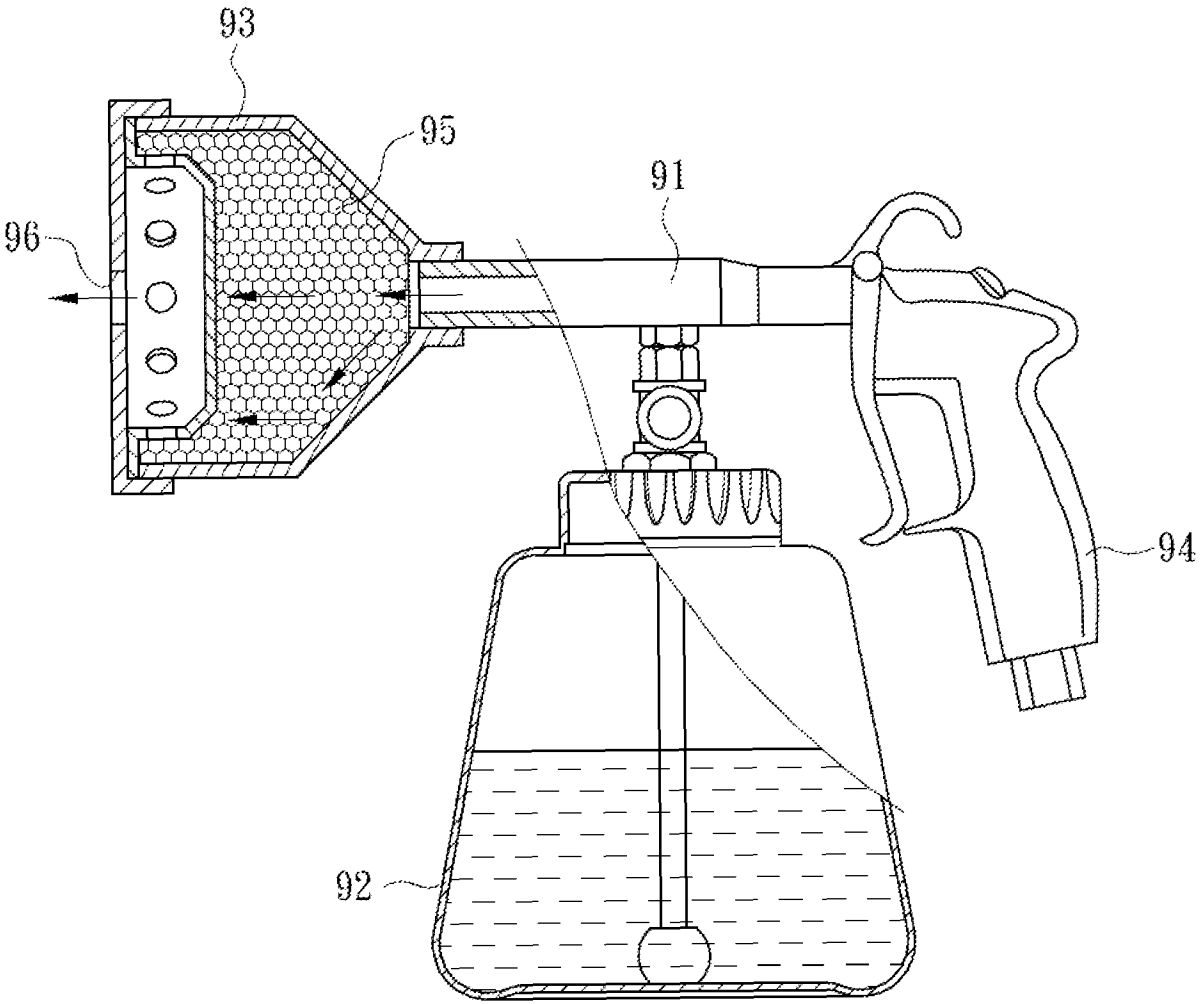
FIG. 6 PRIOR ART
FIG. 6 is a schematic view showing a structure of a conventional high pressure spray-cleaning gun.

In practical use of the above-described structure of the present invention, as shown in FIG. 5, the inlet end 13 of the back cover 111 is assembled to a high pressure spray-cleaning gun. The high pressure spray-cleaning gun is comprised of a handle 61, a T junction 62, and a cleaning solution receiver 63. High pressure gas is inputted and flows through the T junction 62 to produce a Venturi tube effect, so that the cleaning solution in the cleaning solution receiver 63 is pumped from the inlet end 13 of the back cover 111 into the buffer space 22 of the back cover 111. Next, the gas initially impacts on the cone 211 of the wind averaging piece 21, and the cone 211 can provide a flow-guiding effect so that the cleaning solution flows more uniformly into the porous body 31. Furthermore, when the cleaning solution passes through the wind averaging piece 21, the through holes 23 that are inclinedly arranged circumferentially along the wind averaging piece 21 create a vortex flow effect on the cleaning solution passing through the wind averaging piece 21, thereby significantly enhancing the effect of forming foam from the cleaning solution when entering the porous body 31.

The foam formed in the porous body 31 is pushed with the high pressure gas and passes through the diffusing piece 41. Due to the through holes 42 that are similarly inclinedly arranged circumferentially along the diffusing piece 41, a vortex flow effect can also be created on the foam passing through the diffusing piece 41, so that the foam enters and is remixed within the foam collecting chamber 56. The conical surface 54 on the inner edge of the front cover 112 enables the foam entering the foam collecting chamber 56 to be compressed and gathered together into a lump. Finally, the foam is released from the outlet end 52 of the front cover 112 with pressure air, such that the foam is sprayed out along the divergent surface 55 on the inner edge of the outlet end 52 of the front cover 112 onto the surface of an article to be cleaned in a jet form.

As seen from the above description, the arrangement of the wind averaging piece 21 in the present invention enables the cleaning solution to flow more uniformly into the porous body 31. When the cleaning solution passes through the wind averaging piece 21, the through holes 23 that are inclinedly arranged circumferentially along the wind averaging piece 21 can create a vortex flow effect on the cleaning solution, thereby significantly enhancing the effect of forming foam from the cleaning solution when entering the porous body 31. Moreover, the diffusing piece 41 of the present invention enables the foam formed in the porous body 31 to be mixed and diffused again due. to the vortex flow effect such that the foam can be more uniform and finer. Since the inner edge of the outlet end 52 of the front cover 112 has a divergent surface 55 that gradually diverges outwardly, the foam can be sprayed out more divergently from the foam collecting chamber 56. Thus, the foam can be quickly sprayed over the surface of an article to be cleaned so as to significantly shorten the working time spent by the user to spray the foam.

In summarization of the foregoing description, the foam generating apparatus according to the present invention meets the requirements of inventiveness and industrial applicability of patents as compared with products of the same type. Those skilled in the art can now appreciate from the foregoing detailed description that above-described objects can be achieved by the present invention, and the application for a utility model patent is duly filed accordingly.

What is claimed is:

1. A foam generating apparatus, comprising:

a body having a containing space inside and having an inlet end formed at one end and an outlet end formed at the other end;

a wind averaging piece contained in the containing space of the body and adjacent to the inlet end, a buffer space being defined between the side of the wind averaging piece toward the inlet end of the body and the inner edge of the inlet end, and the wind averaging piece being provided with a plurality of through holes; and a porous body disposed in the containing space of the body and abutting against the side of the wind averaging piece toward the outlet end of the body, and a foam collecting chamber being defined between the porous body and the inner edge of the outlet end of the body, wherein the wind averaging piece is cone shaped with the apex of the cone toward the inlet end and the through holes are radially arranged.

2. The foam generating apparatus as described in claim 1, wherein the body is comprised of a front cover and a back cover, the back cover is formed with an engaging portion at the end edge of the back cover, the front cover is formed with an assembling portion at the end edge of the front cover, corresponding to the engaging portion of the back cover, and the front cover has the assembling portion of a connecting end correspondingly engaged with the engaging portion of the back cover.

3. The foam generating apparatus as described in claim 1, wherein the through holes are inclinedly arranged circumferentially along the wind averaging piece.

4. The foam generating apparatus as described in claim 1, wherein an abutting portion is formed at an appropriate position on the inner edge of the body and the end edge on the side of the wind averaging piece toward the inlet end abuts against the abutting portion.

5. The foam generating apparatus as described in claim 1, wherein a diffusing piece is further disposed in the foam collecting chamber of the body, and the diffusing piece abuts against the porous body at one side of the diffusing piece and is provided with a plurality of through holes that are radially arranged and inclinedly arranged circumferentially along the diffusing piece.

6. The foam generating apparatus as described in claim 1, wherein the body is formed with a conical surface gradually converging toward the outlet end at the end edge of the body, and the outlet end is formed with a divergent surface gradually diverging outwardly at the end edge of the outlet end.

* * * * *